US005661256A

United States Patent [19]

Sutula, Jr. et al.

[11] Patent Number: 5,661,256

[45] Date of Patent: Aug. 26, 1997

[54] SLIDER MEMBER FOR BOOSTER EXPLOSIVE CHARGES

[75] Inventors: Daniel P. Sutula, Jr., Farmington; Ronald M. Dufrane, North Granby; Daniel A. Toro, Waterbury, all of Conn.; Lyman G. Bahr, Payson, Utah; Brendan M. Welch, Farmington, Conn.; Ronald D. Thomas, Woodland Hills, Utah

[73] Assignee: The Ensign-Bickford Company, Simsburry, Conn.

[21] Appl. No.: 575,244

[22] Filed: Jan. 16, 1996

[51] Int. Cl.[6] ..... C06C 5/06

[52] U.S. Cl. ..... 102/275.4; 102/275.6; 102/275.12; 102/318; 102/322

[58] Field of Search ..... 102/275.2, 275.3, 102/275.4, 275.5, 275.6, 275.7, 275.11, 275.12, 318, 322

[56] References Cited

U.S. PATENT DOCUMENTS

| | | | |
|---|---|---|---|
| 4,060,034 | 11/1977 | Bowman et al. | 102/275.5 |
| 4,383,484 | 5/1983 | Morrey | 102/275.3 |
| 4,637,312 | 1/1987 | Adam et al. | 102/275.12 |
| 4,765,246 | 8/1988 | Carlsoon et al. | 102/275.12 |
| 4,796,533 | 1/1989 | Yunam | 102/275.12 |
| 4,799,428 | 1/1989 | Yunan | 102/275.3 |
| 4,815,382 | 3/1989 | Yunan | 102/275.7 |
| 4,938,143 | 7/1990 | Thomas et al. | 102/275.4 |
| 5,377,592 | 1/1995 | Rode et al. | 102/210 |

*Primary Examiner*—Harold J. Tudor

*Attorney, Agent, or Firm*—Victor E. Libert; Frederick A. Spaeth

[57] ABSTRACT

A slider (36) has a base fixture (40) and a shielding tube (42). The slider (36) is used to operably couple a detonator (44) to a detonating cord (62) that passes through a booster device (10), i.e., to prevent the detonating cord (62) from directly initiating or fracturing the booster (10). The base fixture (40) includes input lead-retaining means for disposing the input lead (47) of a detonator (44) in signal transfer relation to the detonating cord (62). Optionally, the slider (36) has a detonator retainer (38) for carrying the detonator (44) on the slider (36). Preferably, the detonator retainer (38) is able to hold detonators of various lengths in proper position to initiate the booster device (10). By disposing the shielding tube (42) on the slider (36) a booster device (10) can be used with various detonating cords (62) and a slider (36) having a shielding tube (42) suitable for the chosen detonating cord (62) can be inserted into the booster device (10).

8 Claims, 7 Drawing Sheets

SLIDER MEMBER FOR BOOSTER EXPLOSIVE CHARGES

BACKGROUND OF THE INVENTION

1. Field of the Invention

The present invention relates to booster charge assemblies for borehole blasting and in particular to slider devices for coupling booster explosive charges to downline detonating cords.

2. Related Art

U.S. Pat. No. 4,938,143 issued Jul. 3, 1990 to R. D. Thomas et al and entitled "Booster Shaped For High-Efficiency Detonating", discloses a booster explosive having an "interface" surface at one end which is configured to contact a column of a relatively insensitive explosive while being directed towards the majority of the insensitive explosives content of the column. The body portion of the booster has sides which taper to an opposite, second end thereof which second end has a cross-sectional area which is smaller than the interface end. While Thomas et al discloses a wide variety of such tapered shapes and illustrates many in the drawings, the preferred embodiment is shown in FIG. 5 of Thomas et al wherein the booster explosive has generally the configuration of a frustrum of a right angle cone. The Thomas et al booster is disposed at or near the bottom of a borehole filled with a mass of insensitive explosive, typically a blasting agent, with the base facing upwardly towards the major portion of explosive within the borehole. Commercially available embodiments of the Thomas et al invention are known in which a booster explosive shaped generally similar to that illustrated in FIG. 5 of Thomas et al is encased within a molded synthetic polymeric (plastic) container. As illustrated in FIG. 5 of Thomas et al, the frustoconical shaped booster contains three bores formed therein, one of which comprises a dead-end passageway (152) within which a blasting cap (154) is inserted, another of which passageway (148) extends through the booster explosive for passage therethrough of its signal transmitting cord (156) to the surface. A third passageway (146) extends along the longitudinal center axis of the booster explosive and is stated to permit threading therethrough of the signal transmission cord of another detonator positioned in the borehole below the illustrated booster.

A prior art cast booster device was sold under the trade designation DETADRIVE™. The device comprised a polymeric ("plastic"), generally cylindrical container that defined a cylinder wall and a container bottom. The top of the container was open to facilitate pouring molten explosive therein. The bottom of the container was molded to define a detonator well and a central straw that defined a passage through the booster charge. The bottom of the container was configured to receive a coupling device that carried a percussion primer-activated detonator that was coupled to the detonating cord downline by an explosive coupling element. A similar coupling element and percussion primer-activated detonator are shown in U.S. Pat. No. 4,796,533 to Yunan, dated Jan. 10, 1989.

SUMMARY OF THE INVENTION

The present invention relates to a slider member for a booster explosive device comprising an explosive primer charge and having a first coupling end and a longitudinally-spaced apart second end. Such primer charges have formed therein a detonator well having an end wall and a longitudinal line bore which extends therethrough to permit a detonating cord to be threaded from and through the coupling end to and through the second end. The slider member comprises a base fixture dimensioned and configured to engage the coupling end of the booster explosive device. There is a shielding tube having a tube bore extending therethrough to slidably receive a downline therein. The shielding tube is dimensioned and configured to decouple detonating cord disposed in the tube bore from the booster explosive device. There is also an input lead retaining means for disposing the input lead of a detonator in signal transfer relation to such detonating cord.

According to one aspect of the invention, the base fixture may define a pass-through aperture aligned with the tube bore. The pass-through aperture is dimensioned and configured to slidably receive such detonating cord therethrough.

According to another aspect of the invention, the shielding tube may comprise a polymeric material comprising a closed cell foamed material. Alternatively, the shielding tube may have a cellular internal structure.

According to still another aspect of the invention, the base fixture may comprise engagement means for retaining the base fixture in engagement with the coupling end of the booster explosive device when the shielding tube is disposed in the bore.

The slider member may optionally comprise a detonator retaining means for retaining such detonator on the slider member. Preferably, the detonator retaining means may be dimensioned and configured to retain detonators of various lengths with their output ends in proper position relative to such detonator well.

DETAILED DESCRIPTION OF THE INVENTION AND SPECIFIC EMBODIMENTS THEREOF

The present invention provides a slider member for coupling a detonator to a booster charge in a manner that allows a detonating cord to pass through the booster charge. The booster charge has an internal bore through which the detonating cord passes. The slider member includes a shielding tube that is insertable into the internal bore of the booster charge, and the detonating cord passes through the shielding tube as it extends through the booster charge. The shielding tube serves to decouple the detonating cord from the booster charge, i.e., to shield the booster charge from the energy released upon detonation of the detonating cord. Thus, the shielding tube prevents the detonating cord from physically disrupting the booster charge and from initiating the booster charge as a blast initiation signal passes therethrough. By disposing the shielding tube on the slider member, the configuration of the container for the booster is simplified. In addition, since the shielding tube is not integral with the booster charge, the user can select from among slider assemblies having differently configured shielding tubes, to use the slider member having the shielding tube best suited for a particular detonating cord.

Figure 1:
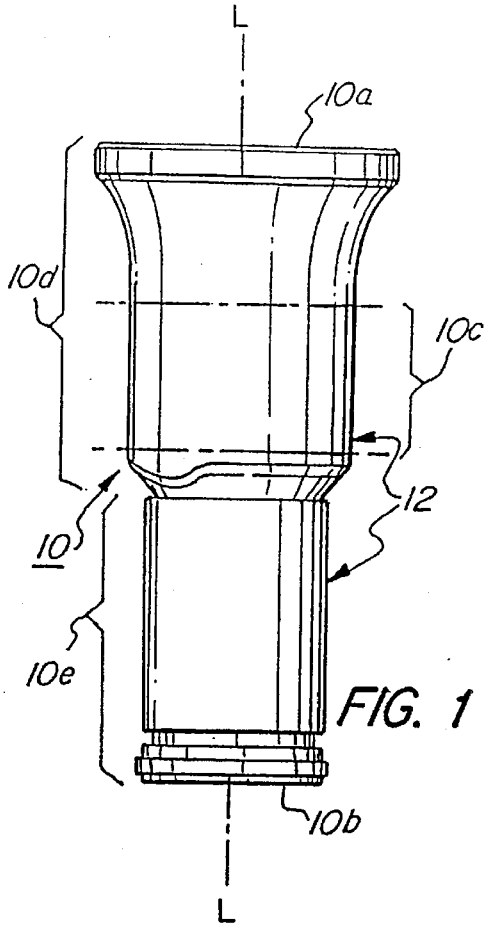
FIG. 1 is an elevation view of a booster explosive device in accordance with one embodiment of the present invention.
Figure 2:
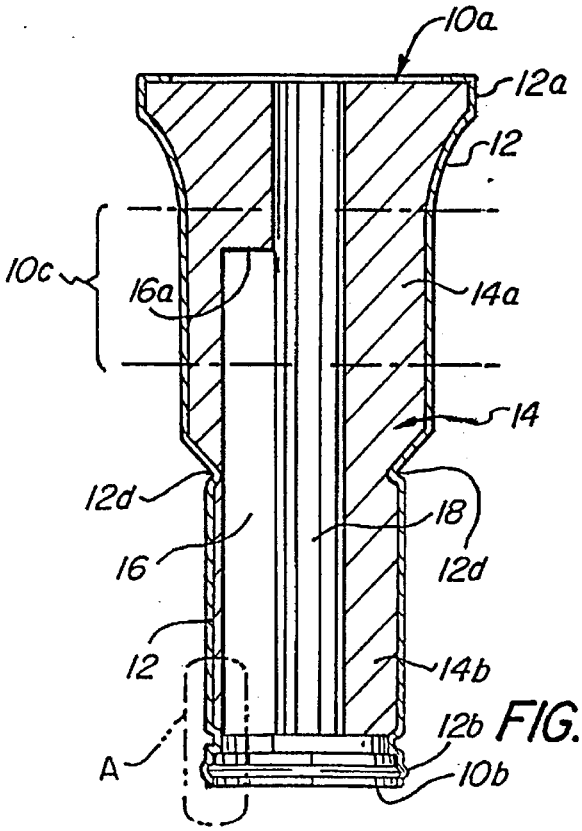
FIG. 2 is a longitudinal cross-sectional view of the device of FIG. 1.
Figure 5:
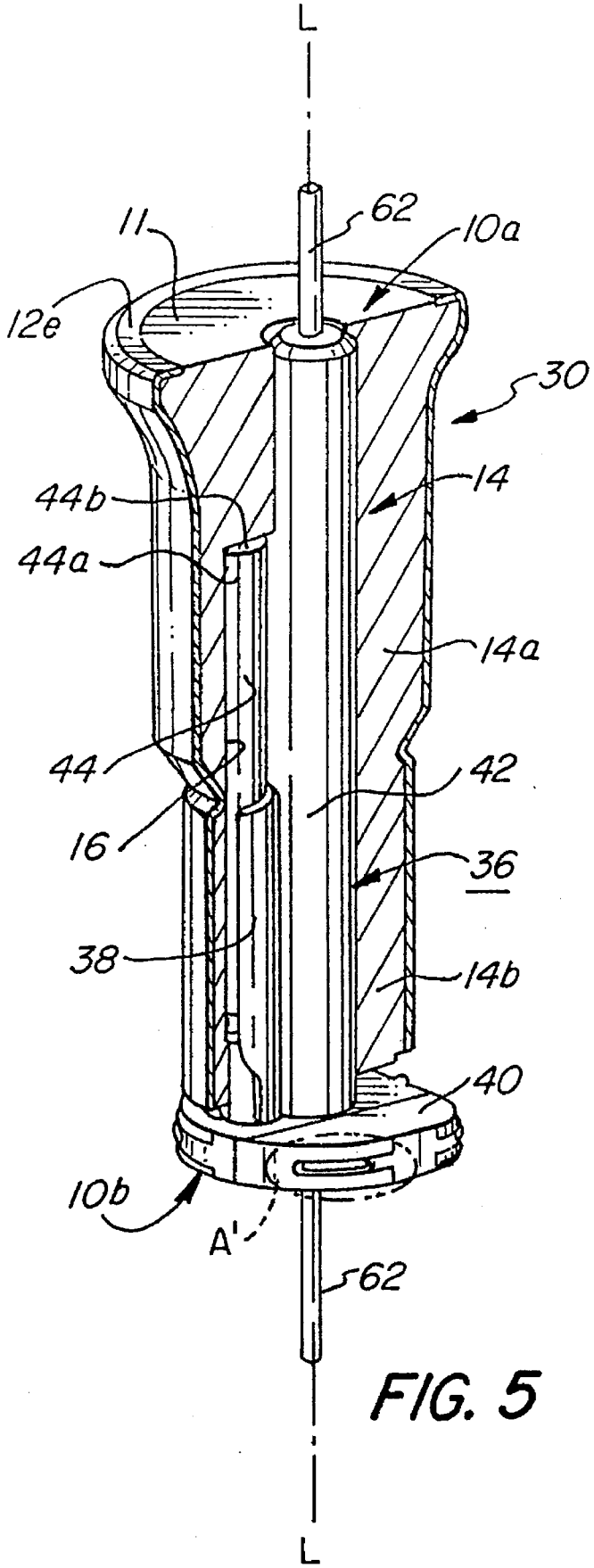
FIG. 5 is a perspective view of a longitudinal cross section of the device of FIG. 1 with the slider member of FIG. 3 and a detonator mounted therein, and a downline extending therethrough.

FIG. 1 shows one type of booster explosive device 10 with which a slider member in accordance with the present invention can be used. Booster explosive device 10 has a longitudinal axis L—L and a hollow housing 12 that defines an enclosure within which is contained an explosive primer charge 14 (FIGS. 2 and 5). Primer charge 14 may comprise any suitable explosive, e.g., a mixture of pentaerythritol tetranitrate ("PETN") and trinitrotoluene ("TNT") and is normally cast within housing 12. Consequently, housing 12 defines the shape of both the exterior of device 10 and of primer charge 14 contained therewithin, the latter comprising a stem portion **14*b* (FIGS. 2 and 5) which, in the illustrated embodiment, is of generally U-shape in cross section, the open mouth of the "U" being occupied by shielding tube 42 (FIG. 3) and detonator retaining means 38, as discussed more fully below. Primer charge 14 has a first coupling end 10*b* and a second end 10*a* spaced-apart from first end 10*b* along longitudinal axis L—L. The main portion 14*a* of primer charge 14 is of larger diameter than stem portion 14*b* and terminates in the outwardly flared active second end 10*a* of device 10. Obviously, any other suitable shape of primer charge 14 may be utilized, including one in which the stem portion 14*b* is of circular cross section, one in which main portion 14*a* has a non-flared configuration, one in which main portion 14*a* and stem portion 14*b* have a constant circular or other cross section, etc. For example, the invention can be practiced with a primer charge cast in a conventional cylindrical configuration. Optionally, the outwardly flared active second end 10*a* of device 10** could be formed in a stepped instead of the smoothly flared configuration shown.

In the illustrated embodiment, booster explosive device 10 (FIG. 1) has an active second end **10*a* which terminates in an active surface 11 (FIG. 5) and which is of larger diameter than an opposite, coupling end 10*b* thereof. Booster explosive device 10 comprises a main section 10*d* corresponding to and comprised of main portion 14*a* of primer charge 14 and a stem section 10*e* corresponding to, and comprised of, stem portion 14*b* of primer charge 14. Active surface 11 of device 10** extends transversely of the longitudinal axis L—L thereof and, in the illustrated embodiment, is substantially flat.

As best seen in FIG. 2, a detonator well 16 and a line bore 18 are formed in primer charge 14, usually by emplacing removable casting fixtures within housing 12 and pouring molten explosive material into housing 12 around the removable casting fixtures. For this purpose the larger diameter end **12*a* of housing 12 is temporarily closed by another fixture during the casting process, after which the explosive material hardens within housing 12 to provide primer charge 14. Detonator well 16 terminates in an end wall 16*a* (FIG. 2) whereas line bore 18 extends entirely through primer charge 14**.

Generally, device 10 (FIG. 1) is configured to have a stem section **10*e* which, in the illustrated embodiment, is of smaller diameter than main section 10*d* and correspondingly provides primer charge 14 thereof with a stem portion 14*b* (FIG. 2) which is of smaller diameter than a main portion 14*a* thereof. Main section 10*d* of device 10 includes a middle section 10*c* which, in the illustrated embodiment, is of generally constant cross section. Detonator well 16 is dimensioned and configured to extend to within the middle section 10*c* of the device 10 and the line bore 18 is dimensioned and configured to receive therein a downline comprising a detonating cord, preferably, to also receive therein a shielding tube for the detonating cord. The device 10 is apertured to admit passage of such detonating cord therethrough. The line bore 18 preferably extends along the longitudinal axis L—L of the device 10**.

Figure 3:
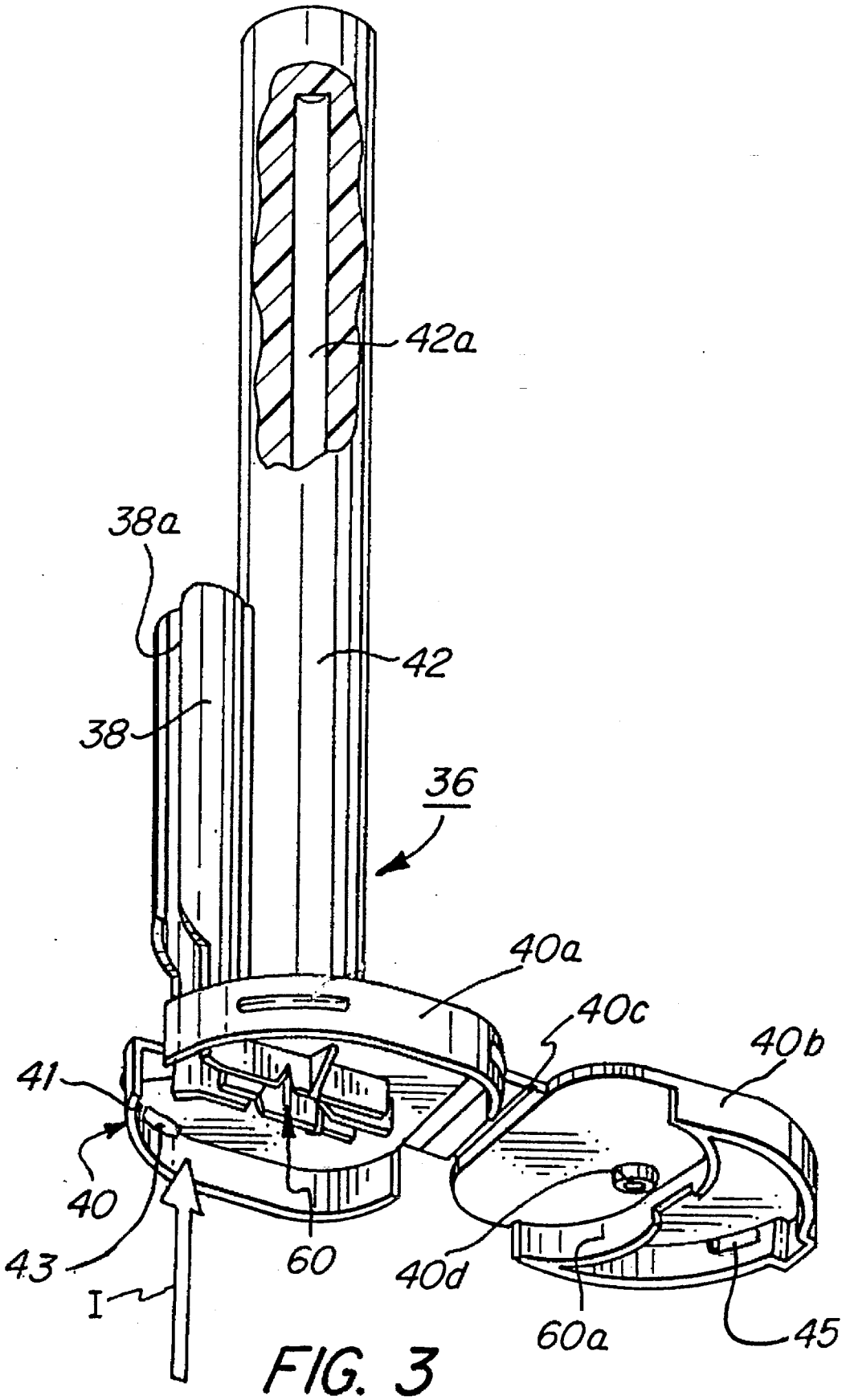
FIG. 3 is a perspective view of a slider member for use with the device of FIG. 1, showing the cover on the base fixture of the slider member in an open position.

Referring now to FIG. 3 there is shown a slider member 36 in accordance with one embodiment of the present invention. Slider member 36 comprises a shielding tube 42 carried on a base fixture 40 which, in the illustrated embodiment, is comprised of a base chamber **40*a* defined in part by a base plate 41, and a hinged cover 40*b* which is shown in FIG. 3 in the open position. Shielding tube 42 comprises a solid tubular wall that defines a tube bore 42*a* extending entirely therethrough. An optional detonator retaining means comprising detonator retainer 38 is carried on the slider member 36**.

Detonator retainer 38 is seen to comprise a tube-like structure having a longitudinally extending slot **38*a* formed therein and is otherwise dimensioned and configured to receive therein a detonator having an output end. The detonator may be inserted into detonator retainer 38 through slot 38*a*. Detonator retainer 38 is dimensioned and configured so that detonators of different lengths may be retained therein with, in each case, the output end thereof in proper position, i.e., in close proximity to, or abutting contact with, the end wall 16*a* of detonator well 16**, as discussed below.

Within base chamber **40*a* there is formed lead-retaining means 60 which, as described in detail in co-pending patent application Ser. No. 08/548,813, filed on Jan. 11, 1996, in the name of D. P. Sutula, Jr. et al. for "METHOD AND APPARATUS FOR TRANSFER OF INITIATION SIGNALS", cooperates with complementary lead-retaining means 60*a* formed in hinged cover 40*b*, to maintain short lead of a detonator (not shown) in signal transfer communication with the detonating cord downline (not shown), when hinged cover 40*b* is closed about hinge 40*c*. Hinged cover 40*b* has an aperture 40*d* formed therein which cooperates with an aperture (not shown) in base plate 41 when hinged cover 40*b* is in its closed position, to form a pass-through aperture in the base fixture. Hinged cover 40*b* is closed by pivoting it about hinge 40*c* and is retained in its closed position by the engagement of a pair of slots and corresponding protruding lips formed in base fixture 40. FIG. 3 shows one slot 45 formed at the end of hinged cover 40*b* which is opposite hinge 40*c* and a corresponding lip 43** formed at the end of base chamber 40*a* which is opposite hinge 40*c*. When hinged cover 40*b* is closed by rotating it about hinge 40*c*, lip 43 engages slot 45 to lock hinged cover 40*b* in place. The pass-through aperture formed when cover 40*b* is in the closed position is aligned with the tube bore 42*a* so that a detonating cord can be threaded through both shielding tube 42 and base fixture 40.

While a detonator having a conventional single line input lead could be emplaced in the slider unit 36 of FIG. 3 for use in conjunction with the explosive booster device of the present invention, it is preferred to employ a detonator having a multi-line input lead, preferably, a looped multi-line input lead, as disclosed in co-pending patent application Ser. No. 08/548,815, filed on Jan. 11, 1996, in the name of E. L. Gladden et al, for "DETONATORS HAVING MULTIPLE-LINE INPUT LEADS". Aside from the preferred multi-line input lead, the detonator may be of conventional construction and may comprise either a delay detonator (usually) or an instantaneous-acting detonator (rarely).

Figure 4A:
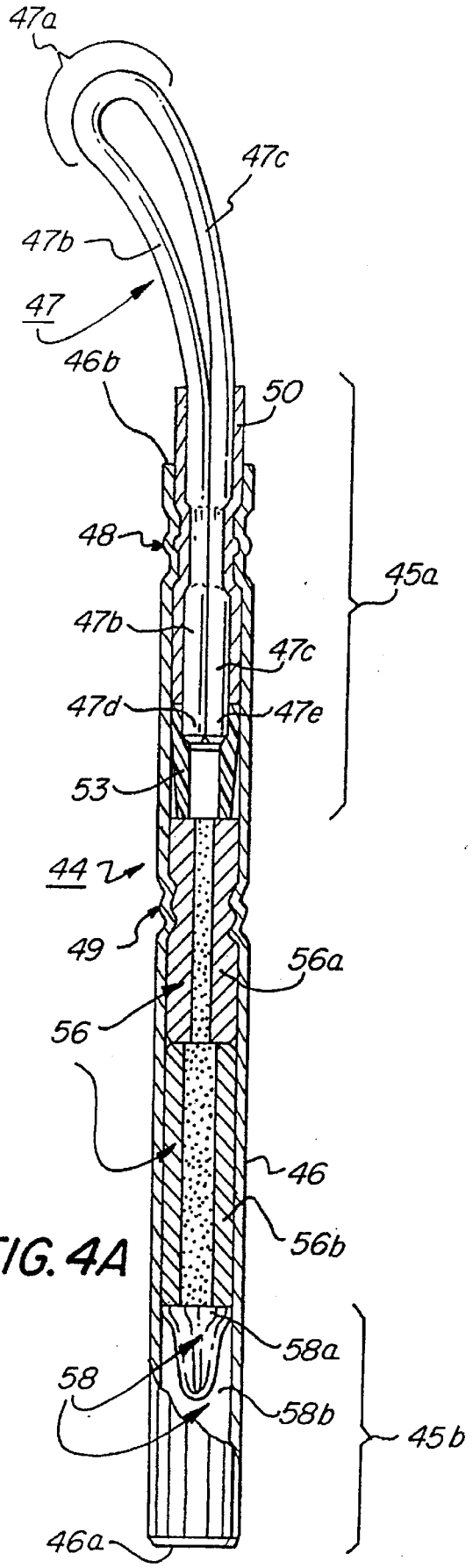
FIG. 4A is a longitudinal cross-sectional view of a delay detonator.

Referring now to FIG. 4A, a delay detonator is generally indicated at 44 and comprises an elongate tubular casing or shell 46 made of a suitable plastic or metal, such as a semi-conductive plastic material or, as in the illustrated embodiment, a metal such as aluminum or copper. Shell 46 has a closed end 46*a* defining the end of the output section 45*b* and an opposite, open end 46*b* at the entry to the input section 45*a*. The closed end 46*a* is closed by shell 46 which is configured as a continuous wall at closed end 46*a*. The open end 46*b* is open to provide access of components to the interior of shell 46 and is eventually sealed by bushing 50 and bushing crimp 48. Bushing 50 is for this purpose usually made of a resilient material such as a suitable rubber or other elastomeric polymer. In the illustrated embodiment, a looped input lead 47 has a bight portion 47*a* from which extend two signal transmission lines 47*b*, 47*c* each terminating in a respective signal-emitting end 47*d*, 47*e*. Looped input lead 47 is secured within shell 46 with signal-emitting ends 47*d*, 47*e* received within a static electric isolation cup 53 which, as is well-known in the art, serves to divert any static electric charge which builds up in looped input lead 47 to shell 46, thereby preventing accidental detonation of detonator 44 by a static electricity discharge.

A pyrotechnic delay train 56 is disposed within shell 46 and is comprised of a sealer member 56*a* and a delay member 56*b* and a detonator output charge 58 in turn comprised of primary and secondary charges 58*a*, 58*b*, all connected in series and terminating at the closed end 46*a* of shell 46. Pyrotechnic delay train 56 comprises tubes of a readily deformable soft metal such as lead, which contain a core of a suitable pyrotechnic composition. A second crimp 49 is formed in shell 46 to retain pyrotechnic train 56 in place therewithin. Primary explosive charge 58*a* may comprise any suitable primary explosive, e.g., lead azide or DDNP (diazodinitrophenol), and secondary explosive charge 58*b* may comprise any suitable secondary explosive, e.g., PETN.

As those skilled in the art will appreciate, sealer member 56*a* and delay member 56*b* may be eliminated to provide an instantaneous-acting detonator such as that illustrated in FIG. 4B and described below.

Delay detonators supplied with electronic delay elements in lieu of the pyrotechnic delay train 56 may also be employed. Such electronic delay elements (not shown) may be used in conjunction with any suitable type of input lead, for example, looped input lead 47 made of shock tube or deflagrating tube, which is used to transmit a non-electric e.g., an impulse signal (which may be amplified or generated by a small amplifier explosive charge, not shown, located within the detonator shell) to generate an electrical signal by imposing the (optionally amplified) impulse signal upon a piezoelectric generator within the shell. The resulting electrical signal is transmitted to an electronic circuit, positioned where delay train 56 of the FIG. 4A embodiment is positioned. The electronic circuit includes a counter to provide a timed delay after which a capacitor circuit is triggered to initiate the output explosive charge. Such electronic delay elements and detonators including the same are disclosed in U.S. Pat. No. 5,377,592, "Impulse Signal Delay Unit", issued on Jan. 3, 1995 to K. A. Rode et al, and U.S. Pat. No. 5,435,248, "Extended Range Digital Delay Detonators", issued on Jul. 25, 1995 to K. A. Rode et al. The disclosures of these patents are hereby incorporated by reference herein. Accordingly, delay detonators may have either a pyrotechnic or an electronic delay element as the immediate target of the signal emitted from the signal-emitting ends 47*d*, 47*e* of signal transmission lines 47*a*, 47*b*.

Figure 4B:
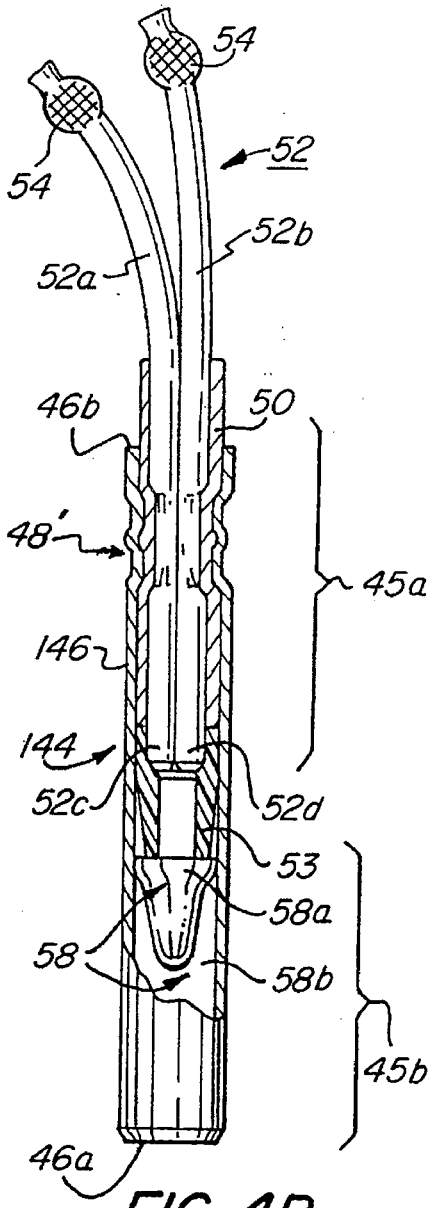
FIG. 4B is a view identical to FIG. 4A but of an instantaneous-acting detonator usable in the slider member of FIG. 3.

The embodiment of FIG. 4B illustrates an instantaneous-acting detonator 144 which, as is well-known in the art, may be attained by simply omitting the delay train 56 from the construction illustrated in FIG. 4A so that the signal emitted from the signal-emitting ends of the input lead and through isolation cup 53 impinge directly on the detonator explosive charge 58. Shell 146 of detonator 144 consequently is shorter in length than shell 46 of the FIG. 4A embodiment. In the embodiment of FIG. 4B, detonator 144 includes a multi-line input lead 52 comprising suitable signal transmission lines such as a pair of short lengths of shock tube comprising signal transmission lines 52*a*, 52*b* which are closed at their distal ends by seals 54. The signal transmission lines 52*a*, 52*b* pass through bushing 50 and terminate at respective signal transmitting ends 52*c*, 52*d* thereof within shell 146 adjacent to a static electric isolation cup 53. Except as noted above, the other components of instantaneous-acting detonator 144 are identical to those of delay detonator 44 of FIG. 4A, are numbered identically thereto and therefore are not further described with respect to their structure. Aside from crimps 48, 48' and 49, the exterior surfaces of detonators 44 and 144 are generally smooth.

A signal induced in looped input lead 47 of FIG. 4A or in multi-line input lead 52 of FIG. 4B by any suitable means such as a detonating cord, will pass through isolation cup 53 to initiate either delay train 56 and then output explosive charge 58 (FIG. 4A) or output explosive charge 58 directly (FIG. 4B).

A detonator may have a single line input lead, a looped input lead or a multi-line input lead irrespective of whether it is a delay detonator or an instantaneous-acting detonator.

In order to assemble booster charge assembly 30 (FIG. 5), hinged cover 40*b* (FIG. 3) is opened and a suitable detonator 44 (or 144 (FIG. 4B)) may be inserted through base chamber 40*a* (FIG. 3) and into detonator retainer 38, output end 45*b* first, in the direction of arrow I. Alternatively, the detonator may be inserted into detonator retainer 38 laterally, through slot 38*a*. Detonator retainer 38 optionally contains on the interior thereof stop means (not shown) such as one or more detents dimensioned and configured to engage crimp 48 (or some other feature such as crimp 49) to fixedly retain the detonator 44 or 144 within detonator retainer 38. Detonator 44 or 144 is dimensioned and configured so that when positioned by such detents the closed end of the detonator will be properly positioned immediately adjacent to or in abutting contact with end wall 16*a* (FIG. 2) of detonator well 16 when slider member 36 (having the detonator therein) is engaged with the coupling end of primer charge 14. Optionally, there may be detents at different positions in detonator retainer 38 so that detonators of different lengths between such crimps and output tips will be properly positioned by appropriate detents. Alternatively, detonator retainer 38 may be configured simply to retain in proper position various detonators by engaging the smooth surface of the detonators without regard to any crimp. In either case the detonators of various lengths can be retained with their output sections 45*b* positioned for close proximity to, or in abutting contact with, the end wall 16*a* of the detonator well.

Figure 4E:
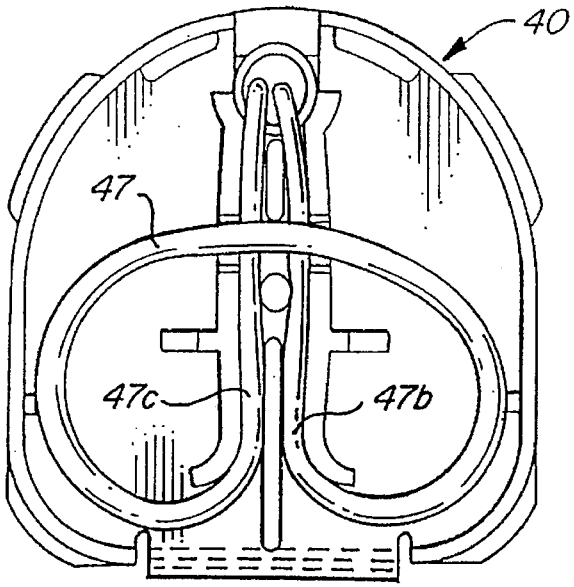
FIGS. 4C, 4D and 4E are plan views of the base fixture of the slider member of FIG. 3 with detonator input leads therein.
Figure 4D:
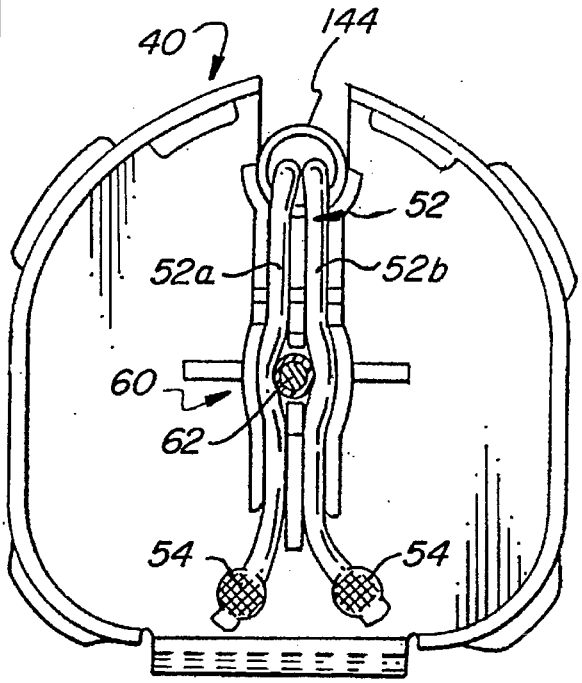
Figure 4C:
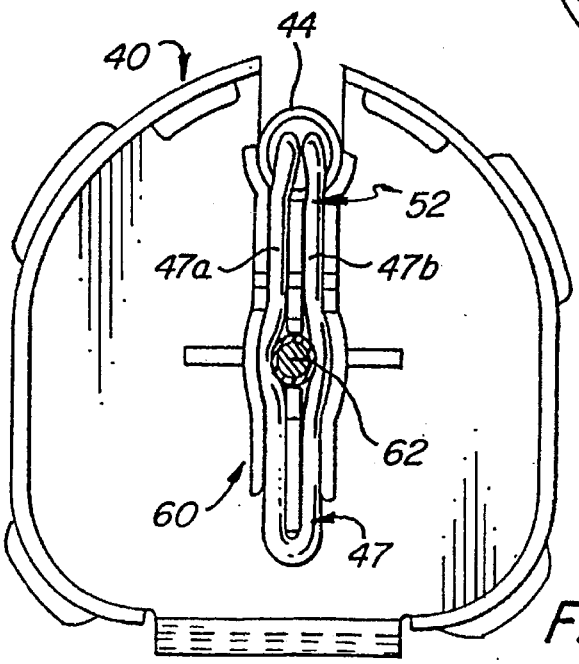

Preferred configurations for such input leads in lead-retaining means 60 are illustrated in FIGS. 4C, 4D and 4E. Such configurations provide multiple points of abutting contact between the detonating cord and the input lines, and thus provide enhanced reliability in the transfer of the initiation signal from the detonating cord to the detonator. The term "abutting contact" indicates contact that results from tangential juxtaposition of the input lead and the detonating cord, optionally with mild lateral force to assure surface contact between them. Equally reliable signal transfer is attained with multiple points of abutting or "casual" contact as with a single point of firm contact, the latter resulting from pressure applied in pushing the input lead against the detonating cord to cause one or both to deform into substantial surface area contact with the other. While firm contact generally enhances signal transfer reliability relative to casual contact, even a single point of firm contact can inhibit the detonating cord from sliding through the pass-through aperture and can therefore inhibit proper placement of a booster charge with which the invention is used. Casual, multiple abutting contact thus provides equally reliable signal transfer and better slidability than firm contact.

After detonator 44 or 144 is inserted within detonator retainer 38, looped input lead 47 of detonator 44 (FIG. 4A) or multi-line input lead 52 of detonator 144 (FIG. 4B) is engaged with lead-retaining means 60 and hinged cover 40*b* is closed to retain the engaged input lead 47 or 52 in place. Slider member 36 is then inserted within device 10 by aligning shielding tube 42 with line bore 18 and detonator 44 in detonator retainer 38 with detonator well 16. The assembly of the detonator within slider member 36 is normally carried out by factory assembly, so that in the field the user need not be concerned about properly seating the detonator and its input lead within slider member 36, but need merely insert the pre-assembled slider unit/detonator assembly into the booster device 10 to produce a booster charge assembly.

Preferably, a detonating cord extending through the booster charge has, in cross section, a major flattened peripheral arc from which the signal output from the cord is more effectively transferred than at other peripheral regions. For example, the detonating cord may have an oval cross-sectional configuration having a major cross-sectional axis and a minor cross-sectional axis, and the major flattened arc extends along the major cross-sectional axis. Preferably, the input lead of the detonator is disposed in contact with the major flattened peripheral arc of the detonating cord. Optionally, the input lead may comprise an input line having, in cross section, a major flattened peripheral arc for increased sensitivity to the detonating cord signal, and the major flattened peripheral arc of the detonating cord is in contact with the major flattened peripheral arc of the input lead. The slider member may be configured to facilitate such contact. For example, the pass-through aperture of the base fixture may be oval to conform to the detonating cord and bias the detonating cord into a particular orientation, and the lead-retaining means may likewise be configured to dispose the input lead so that its major flattened peripheral arc is in contact with the major flattened peripheral arc of the detonating cord, preferably with its own major flattened peripheral arc. Such detonating cords, input leads and slider units are disclosed in co-pending aforesaid patent application Ser. No. 548,813. However, shielding tube bore 42*a* is preferably larger in diameter than the pass-through aperture in the base fixture, and preferably tapers down to the diameter of the pass-through aperture to facilitate threading a detonating cord through the slider device.

Figure 6:
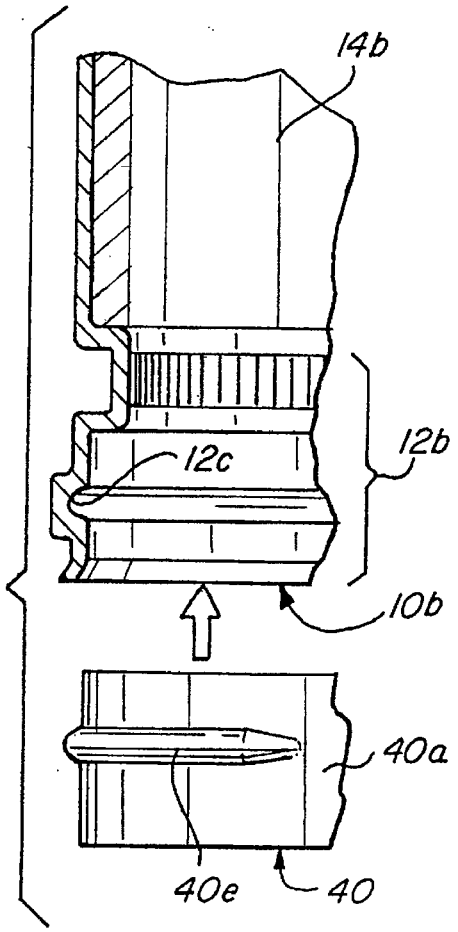
FIG. 6 is an exploded, partial elevation view enlarged relative to FIGS. 2 and 5, of approximately that portion of FIG. 2 which is enclosed by the dash-line area A and that portion of FIG. 5 which is enclosed by dash-line area A'.

As shown in FIG. 6, base fixture 40 has base engagement means comprising, in the illustrated embodiment, projections 40*e* formed about the periphery thereof. Coupling end 10*b* of device 10 is comprised of an extension end 12*b* which has housing engagement means comprising, in the illustrated embodiment, recesses 12*c* formed thereon. Projections 40*e* of base fixture 40 are dimensioned and configured to be snap-inserted into, and engage with recesses 12*c* of housing 12, so that slider unit 36 will positively engage and lock to housing 12 with shielding tube 42 received within line bore 18 and detonator 44 and its detonator retainer 38 received within detonator well 16.

In order to connect the assembled device as part of a blasting system, a downline 62 (FIG. 5), which may comprise any suitable brisant signal transmission line, such as a detonating cord, for example, a low energy detonating cord containing therein from about 1.2 to 1.7 grams per meter (6 to 8 grains per foot) of a suitable high explosive such as PETN, HMX, RDX or plastic bonded explosive ("PBX") is threaded through tube bore 42*a* (FIG. 3) of shielding tube 42 from active surface 11 of device 10 (FIG. 5) and passed through base fixture 40 via aperture 40*d* in signal transfer engagement with input lead 52. Input lead 47 or 52 is retained in such engagement by its engagement thereof with lead-retaining means 60 and complementary lead-retaining means 60*a*. The insertion of slider member 36 with detonator 44 thereon as described above yields a booster charge assembly that is in condition to be initiated by downline 62 via input lead 47 or 52.

As is well-known to those skilled in the art, a booster charge assembly 30 may slide along downline 62 to a selected depth within a borehole or other formation within which assembly 30 is to be utilized, as described in more detail below. It will further be appreciated by those skilled in the art that conventional single input lead line detonators may also be employed in accordance with the present invention. However, multi-line input leads, and particularly the looped input lead illustrated in FIG. 4A hereof, are preferred because they provide redundant signal inputs to the detonator thereby drastically reducing if not eliminating altogether initiation failures. The multi-line input leads provide multiple contact points and better contact between downline 62 and the input leads 47 or 52 while nonetheless permitting good sliding contact between downline 62 and the input leads. The multi-line input lead construction is described in co-pending patent application Ser. No. 08,548,815, filed on Jan. 11, 1996, in the name of E. L. Gladden et al, for "DETONATORS HAVING MULTIPLE-LINE INPUT LEADS".

It will be noted that downline 62 extends through the geometric center of device 10 and of charge assembly 30, i.e., downline 62 is coincident with the longitudinal axis of device 10. This facilitates smooth sliding of device 10 along downline 62 until the desired location is reached.

Figure 9:
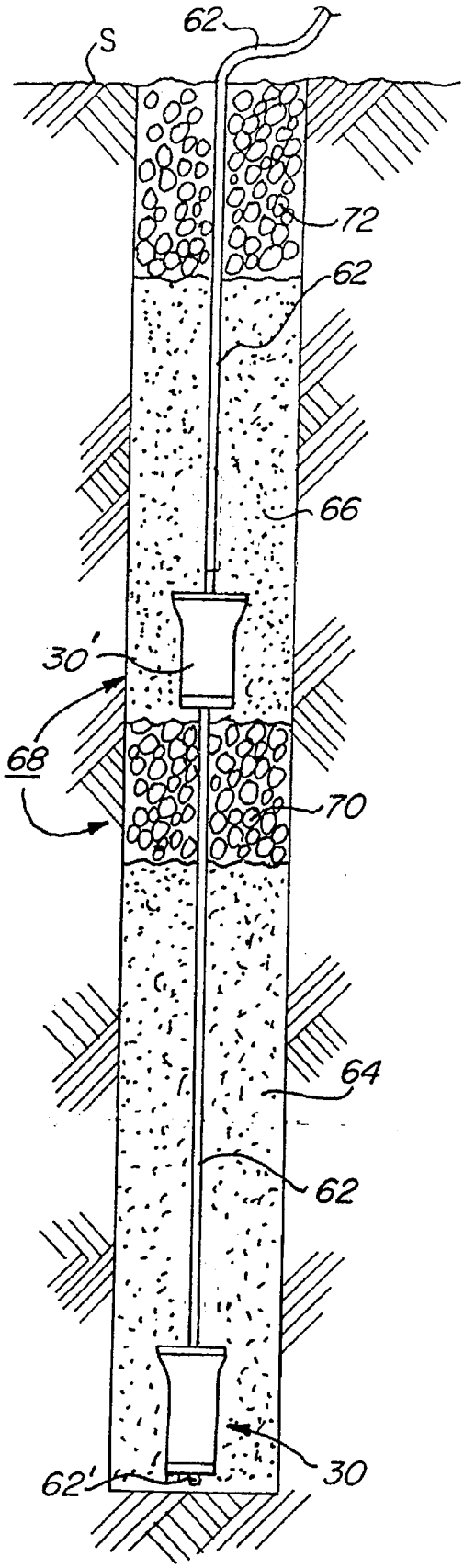
FIG. 9 is a partly cross-sectional schematic view of a borehole blasting site in which a slider member of the present invention is used with a booster charge.

In order to prepare the borehole 68 (FIG. 9), a suitable downline 62, such as a low energy detonating cord, is threaded through a booster charge assembly 30 (having a detonator suitably mounted therein by a slider member according to the present invention) and is knotted (as indicated at 62') to retain charge assembly 30 thereon. Charge assembly 30 is then lowered to the bottom of borehole 68 by means of downline 62 while maintaining one end of downline 62 at the surface S. First blasting charge 64 is then poured into borehole 68 followed by a stemming material such as gravel to provide intermediate stemming section 70. The blasting charge 64 may be any suitable explosive or blasting agent such as an ammonium nitrate-fuel oil ("ANFO") composition. At that point a second booster charge assembly 30' (having a detonator suitably mounted therein) is threaded onto downline 62 and lowered into borehole 68 by sliding by gravity along downline 62 until it encounters the top of intermediate stemming section 70. Second blasting charge 66, which typically comprises the same blasting agent as blasting charge 64, is then poured into borehole 68 and material to provide top stemming charge 72 is added thereover. The portion of downline 62 left on the surface is connected into a suitable blast initiation set-up which usually includes interconnection to explosive devices in numerous other boreholes. As is well-known to those skilled in the art, a borehole may contain only one booster charge or may contain two or more booster charges arranged at different levels in the borehole.

In use, downline 62 is initiated at the surface S by any suitable means (not shown) and the resulting signal travels through downline 62 to initiate a signal in the input leads of the detonators of booster charge assemblies 30 and 30'. The speed of travel of the signal through the detonating cord downline 62 is so high, e.g., in the range of about 6000–7000 meters per second, that the input leads may be considered to be initiated substantially simultaneously. The signal initiated in the input leads initiates the respective delay trains in the detonators and after a suitable delay period of, e.g., from 25 to 1000 milliseconds or more, the respective detonator explosive charges are initiated, which initiates the booster charge assemblies 30 and 30', which in turn initiate their associated main blasting charges 64, 66. As those skilled in the art will appreciate, the delay periods of the respective detonators will be selected so that in a given borehole the charge assemblies 30 and 30' initiated in sequence delay starting from the bottom of a borehole to the top thereof. In some few cases, it may be desired to utilize for one or more of the booster charges in a bore hole an instantaneous-acting detonator such as detonator 144 of FIG. 4B. Normally, delay detonators are utilized in boreholes for reasons well-known to those skilled in the art.

Shielding tube 42 serves to protect booster charge 14 from being initiated or cracked by the explosive force of the detonating cord comprising downline 62, i.e., it "decouples" booster charge 14 from detonating cord. If downline 62 were to directly initiate the booster charge 14 the timing sequence provided by delay trains 56 would be superseded with resulting dire consequences for the effectiveness of the blast pattern. If downline 62 shatters or cracks booster charge 14, the reliability of initiation by detonators 44 is compromised.

Figure 7:
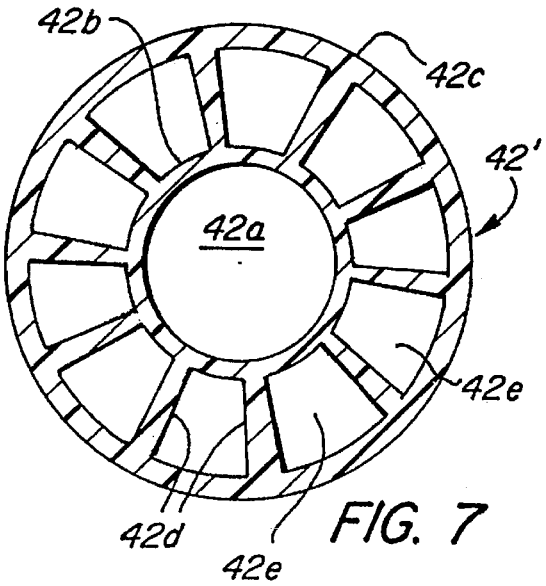
FIG. 7 is a cross-sectional view of a shielding tube in accordance with a particular embodiment of the present invention.

Shielding tube 42 may have various configurations for decoupling the detonating cord from booster charge 14. For example, shielding tube 42 may comprise a solid tube, or it may comprise a rigid foamed polymeric material in which the tube wall defines numerous small cavities formed in a generally random distribution throughout the tube wall. Such materials are well-known to those of ordinary skill in the art to comprise foaming agents that release gases while the material is being molded or extruded. Alternatively, the shielding tube may have a cellular structure determined by the mold or extruder by which tube 42' is formed. In a particular embodiment illustrated in FIG. 7, such a structure may comprise, in cross section, an inner tube or hub **42*b*, within which a detonating cord may be received, and a peripheral outer tube 42*c*. Ribs 42*d* join hub 42*b* and outer tube 42*c* and define empty cells 42*e* that extend longitudinally along tube 42'. Cells 42*e* are sealed at each end so that no liquid or other matter can enter the cells. The empty cells provide a cushion between hub 42*b* and outer tube 42*c* that absorb the energy released by a detonating cord in bore 42*a* and thus reduce the impact of such energy on the surrounding booster charge. If water or other matter enters cells 42*e*, the ability of tube 42'** to absorb the energy released by a detonating cord would be impaired. The previously mentioned foamed material embodiment preferably comprises a closed cell foam material for this reason.

As illustrated, ribs **42*d* are perpendicular to hub 42*b* and tube 42*c* and are disposed along radii of tube 42'. In alternative configurations, ribs 42*d* may be canted so that they join at hub 42*b* and tube 42 at acute angles and so that they are not radially disposed. In still other embodiments, ribs 42*d*** may have curvate or serpentine configurations.

Figure 8:
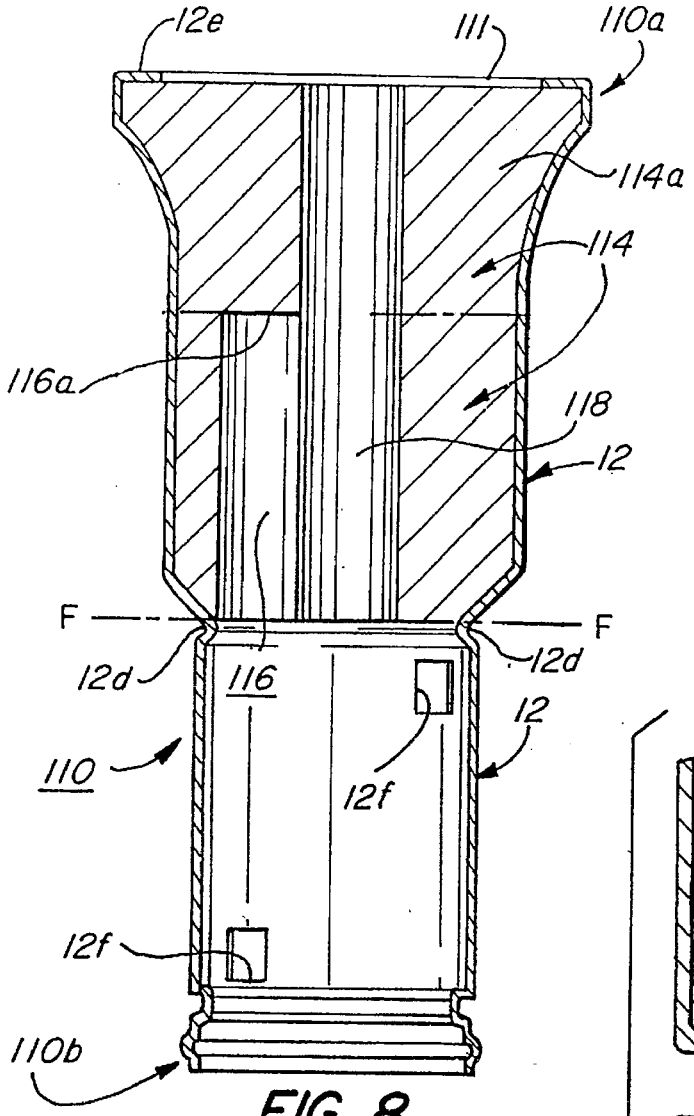
FIG. 8 is a cross-sectional view similar to FIG. 2 of an alternative booster device for use with the present invention.

Referring now to FIG. 8, there is shown an alternate embodiment of a booster charge with which a slider device of the present invention can be used. Booster explosive device 110 has formed therein a detonator well 116 and a line well 118. (Except for the omission of the equivalent of stem portion **14*b* of the FIG. 2 embodiment, the FIG. 8 embodiment is substantially the same as that of the FIG. 2 embodiment. Accordingly, corresponding components are not further described and are identically numbered as in FIG. 2 except for the addition of a prefix 1.) In this embodiment, as in the embodiment of FIG. 2, the end wall 116*a* of detonator well 116 defines a point beyond which output end of a detonator, e.g., the closed end 46*a* of shell 46, does not extend. One feature of the present invention provides that the output end of a detonator, e.g., detonator 44, is positioned in close proximity to or in abutting contact with end walls 16*a* (FIG. 2) and 116*a* (FIG. 8**), respectively.

Primer charge 114, comprises only a main portion **114*a* without a stem equivalent to stem portion 14*b* of the FIG. 2 embodiment. Thus, in casting the explosive to form the primer charge 114 of the FIG. 8 embodiment, housing 12 is filled only to the plane F—F which is taken perpendicularly to longitudinal axis L at the constriction 12*d* formed in housing 12. Once the molten charge hardens to provide main portion 114*a*, the constriction 12*d* in cooperation with rim 12*e* formed at larger diameter end 12*a* of housing 12 will retain the solidified main portion 114*a* securely in place. In this embodiment of the invention, in which the stem portion equivalent to 14*b* of the FIG. 2 embodiment is omitted, the resulting void space surrounding the shielding tube of a slider unit (not shown) inserted within the device 110 may present a problem in lowering the device 110 into boreholes which contain a fluid such as a liquid, e.g., water, or a slurry explosive. For this reason, one or more apertures such as apertures 12*f* (FIG. 8) are formed in the lower portion of housing 12, that is, in the portion of the housing 12 which in the FIG. 2 embodiment encloses stem portion 14*b* of primer charge 14. Apertures 12*f* admit such fluid into housing 12 in order to reduce the bouyancy of device 110** and allow it to sink to the bottom of the fluid-containing borehole or of the deck of the fluid-containing borehole in which it is located. Preferably, two or more such apertures 12*f* are provided in order to facilitate the ingress of the fluid into the lower portion of housing 12 and the escape of air therefrom in order to sink the device 110 within the liquid in which it is placed. Slider device 36 is secured to the coupling end 110*b* of booster device 110 in the same manner as for device 10, and the detonator is properly positioned at the end wall 116*a* just as with device 10.

While the invention has been described in detail with respect to specific preferred embodiments thereof, it will be recognized by those skilled in the art that numerous variations may be made thereto which variations nonetheless comprise substantial equivalents of the preferred embodiments and otherwise lie within the spirit and scope of the appended claims.

What is claimed is:

1. A slider member for a booster explosive device comprising an explosive primer charge and having a first coupling end and a longitudinally spaced-apart second end, the primer charge having formed therein a detonator well having an end wall and a longitudinal line bore which extends therethrough to permit a detonating cord downline to be threaded from and through the coupling end to and through the second end, the slider member comprising;

a base fixture dimensioned and configured to engage the coupling end of the booster explosive device;

a shielding tube carried on the base fixture and having a tube bore extending therethrough to slidably receive a downline therein, the shield tube being dimensioned and configured to extend substantially along the entire length of such longitudinal line bore and to enclose the length of the downline disposed in the tube bore to thereby decouple the downline from such booster explosive device; and input lead retaining means carried on the base fixture for disposing the input lead of a detonator in signal transfer relation to such downline.

2. The slider member of claim 1 wherein the base fixture defines a pass-through aperture aligned with the tube bore, the pass-through aperture being dimensioned and configured to slidably receive such downline therethrough.

3. The slider member of claim 1 wherein the shielding tube comprises a polymeric material comprising a closed cell foamed material.

4. The slider member of claim 1 wherein the shielding tube has a cellular internal structure.

5. The slider member of claim 1 wherein the base fixture comprises engagement means for retaining the base fixture in engagement with the coupling end of the booster explosive device when the shielding tube is disposed in the bore.

6. The slider member of claim 1 or claim 2 further comprising a detonator retaining means for retaining such detonator on the slider member.

7. The slider member of claim 6 wherein the detonator retaining means is dimensioned and configured to retain detonators of various lengths with their output ends disposed in close proximity relative to the end wall of such detonator well.

8. The slider member of claim 6 wherein the detonator retaining means is dimensioned and configured to retain detonators of various lengths with their output ends disposed in abutting contact with the end wall of such detonator well.

* * * * *

UNITED STATES PATENT AND TRADEMARK OFFICE

CERTIFICATE OF CORRECTION

PATENT NO. : 5,661,256
DATED : August 26, 1997
INVENTOR(S) : Daniel P. Sutula, Jr., et al.

It is certified that error appears in the above-indentified patent and that said Letters Patent is hereby corrected as shown below:

In column 6, line 1, insert a comma after "non-electric".

In column 8, line 59, replace the comma after "08" with --/--.

In column 9, line 45, insert --are-- after "30'".

In column 9, line 48, replace "bore hole" with --borehole--.

In column 9, line 55, replace "detonating cord" with --the downline--.

In column 10, line 23, replace "42" with --42c--.

In column 10, line 43 replace "114," with --114--.

In column 11, line 28, replace "shield tube" with --shielding tube--.

Signed and Sealed this

Twenty-fourth Day of March, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,661,256
DATED : August 26, 1997
INVENTOR(S) : Daniel P. Sutula, Jr. et al It is certified that error appears in the above-indentified patent and that said Letters Patent is hereby corrected as shown below:

On the title page, under the heading "U.S. PATENT DOCUMENTS":

In line 4, replace "Carlsoon et al." with --Carlsson et al--;
In line 5, replace "Yunam" with --Yunan--.

Signed and Sealed this
Fourteenth Day of July, 1998

Bruce Lehman

*Attest:*

BRUCE LEHMAN

*Attesting Officer*

*Commissioner of Patents and Trademarks*